US009725269B2

(12) United States Patent
Cheng et al.

(10) Patent No.: US 9,725,269 B2
(45) Date of Patent: Aug. 8, 2017

(54) SHEET WINDING STRUCTURE

(71) Applicant: UBRIGHT OPTRONICS CORPORATION, Taoyuan County (TW)

(72) Inventors: Kuo Wei Cheng, Taoyuan County (TW); Chien Chih Lai, Taoyuan County (TW)

(73) Assignee: UBright Optronics Corporation, Taoyuan (TW)

( * ) Notice: Subject to any disclaimer, the term of this patent is extended or adjusted under 35 U.S.C. 154(b) by 123 days.

(21) Appl. No.: 14/599,565

(22) Filed: Jan. 19, 2015

(65) Prior Publication Data

US 2016/0107858 A1 Apr. 21, 2016

Related U.S. Application Data

(60) Provisional application No. 62/066,338, filed on Oct. 20, 2014.

(51) Int. Cl.

| | |
|---|---|
| ***B65H 75/10*** | (2006.01) |
| ***B65H 18/28*** | (2006.01) |
| ***B65H 75/28*** | (2006.01) |

(52) U.S. Cl.

CPC ..... *B65H 18/28* (2013.01); *B65H 75/10* (2013.01); *B65H 75/28* (2013.01); *B65H 2701/1752* (2013.01); *B65H 2701/515* (2013.01)

(58) Field of Classification Search

CPC ..... B65H 75/10; B65H 75/28; B65H 18/28

See application file for complete search history.

(56) References Cited

U.S. PATENT DOCUMENTS

| | | | | |
|---|---|---|---|---|
| 3,604,651 A * | 9/1971 | Ohno | G03B 17/30 | 242/584.1 |
| 5,785,272 A * | 7/1998 | Slade | B65H 75/28 | 242/532.5 |
| 5,908,173 A * | 6/1999 | De Roeck | B65H 18/00 | 242/609.4 |
| 8,556,206 B2 * | 10/2013 | Eckert | B65H 75/10 | 242/610.3 |
| 2005/0258299 A1 * | 11/2005 | Burchett | B65H 75/10 | 242/532 |

* cited by examiner

*Primary Examiner* — Sang Kim

(74) *Attorney, Agent, or Firm* — Min-Lee Teng; Litron Patent & Trademark Office

(57) ABSTRACT

The present invention discloses a sheet winding structure to reduce indentation transfer occurring because of sheet thickness or adhesive colloidality of the innermost layer of the sheet. The sheet winding structure comprises: a winding core having an outer surface, wherein the outer surface of the winding core comprises a recess thereon; and a sheet winded over the outer surface of the winding core, wherein a beginning portion of the sheet is disposed in the recess.

31 Claims, 9 Drawing Sheets

SHEET WINDING STRUCTURE

CROSS-REFERENCE TO RELATED APPLICATION

This application claims the benefit of U.S. provisional patent application No. 62/066,338, filed on Oct. 20, 2014, which is hereby incorporated herein by reference.

BACKGROUND OF THE INVENTION

1. Field of the Invention

The present invention relates to a sheet winding structure, and more particularly to a sheet winding structure where the beginning portion of the sheet is disposed in the recess of the winding core.

2. Description of Related Art

Due to the progress of technology development, all kinds of sheets (e.g., optical films) are widely used. The sheet is winded on the paper tube (tubular winding core) in the stage of production and process. However, when the sheet is winded on the paper tube, indentation transfer occurs because of sheet thickness or adhesive colloidality of the innermost layer of the sheet. Specifically speaking, when the second layer of the sheet is winded on the beginning portion of the first layer (the innermost layer) of the sheet, the overlap portion of the beginning portion of the first layer and the second layer will destroy surface uniformity of the sheet because there is a gap between the sheet and the paper tube and the sheet will be deformed; the deformation will further affect the outer layers when winding multi-layers such that the sheet can't be used in the subsequent steps. This phenomenon easily happens when the sheet is placed for a long time. It not only reduces the utility rate to increase the cost but also troubles the customers in use. Accordingly, the present invention proposes a sheet winding structure and its manufacturing method to overcome the above-mentioned disadvantages.

SUMMARY OF THE INVENTION

One objective of the present invention is to provide a sheet winding structure to reduce indentation transfer occurring because of sheet thickness or adhesive colloidality of the innermost layer of the sheet. The sheet winding structure comprises: a winding core having an outer surface, wherein the outer surface of the winding core comprises a recess thereon; and a sheet winded over the outer surface of the winding core, wherein a beginning portion of the sheet is disposed in the recess. Preferably, the winding core is a tube body.

In one embodiment of the present invention, the recess is formed by two sidewalls. The two sidewalls intersect at the bottom of the recess. Preferably, the recess is an L-type recess.

In one embodiment of the present invention, the beginning portion of the sheet comprises a first face and a second face opposite to the first face, wherein the first face faces the recess and the second face faces the second layer of the sheet winded over the outer surface of the winding core. Specifically speaking, the beginning portion of the sheet further comprises a thickness face connecting the first face and the second face, and the recess comprises a first surface and a second surface different from the first surface, wherein the thickness face faces the first surface of the recess, and the first face faces the second surface of the recess.

In one embodiment of the present invention, the recess is formed by two sidewalls and a bottom surface between the two sidewalls. Preferably, the recess is a U-type recess.

In one embodiment of the present invention, the beginning portion of the sheet comprises a first face and a second face opposite to the first face, wherein the recess comprises a first surface and a second surface opposite to the first surface, wherein the first face faces the first surface of the recess and the second face faces the second surface of the recess. Specifically speaking, the beginning portion of the sheet further comprises a thickness face connecting the first face and the second face, and the recess further comprises a third surface between the first surface and the second surface, wherein the thickness face faces the third surface of the recess.

Another objective of the present invention is to provide a winding core used for winding a sheet. The winding core used for winding a sheet comprises: a core body; and a buffer layer disposed on the outer surface of the tube body, wherein the buffer layer comprises a foaming material, wherein the foaming material comprises more than 90% of LDPE (low-density polyethylene), the foaming magnification of the foaming material is 10~33, and the thickness of the foaming material is 1~3.3 mm. Preferably, the core body is a tube body.

The detailed technology and above preferred embodiments implemented for the present invention are described in the following paragraphs accompanying the appended drawings for people skilled in this field to well appreciate the features of the claimed invention.

BRIEF DESCRIPTION OF THE DRAWINGS

The foregoing aspects and many of the accompanying advantages of this invention will become more readily appreciated as the same becomes better understood by reference to the following detailed description when taken in conjunction with the accompanying drawings, wherein.

DETAILED DESCRIPTION OF THE ILLUSTRATED EMBODIMENTS

Figure 1A:
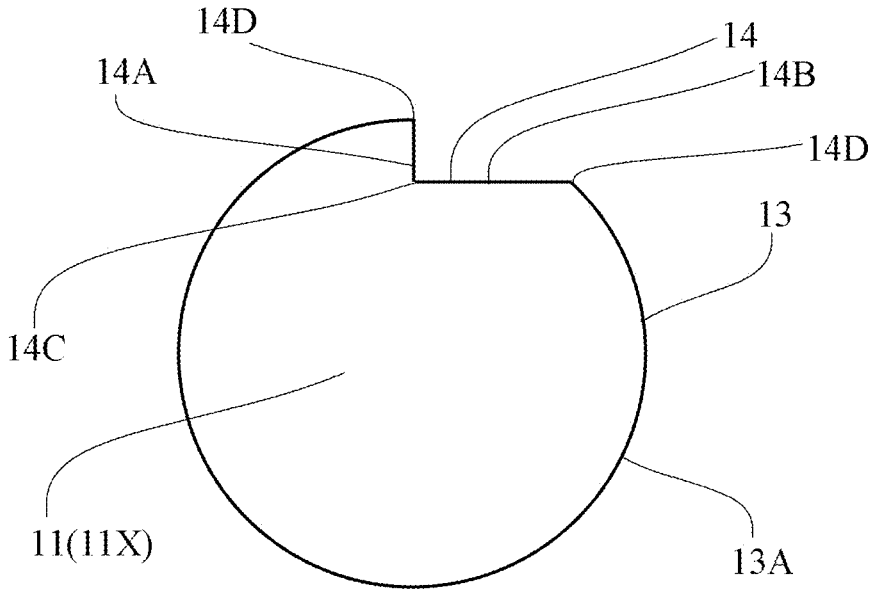
FIG. 1A illustrates a schematic cross-sectional view of a winding core having an outer surface comprising a recess thereon in accordance with a first embodiment in the present invention.

The detailed explanation of the present invention is described as following. The described preferred embodiments are presented for purposes of illustrations and description and they are not intended to limit the scope of the present invention.

The embodiments in the present invention disclose a sheet winding structure and a method for manufacturing a sheet winding structure. The sheet winding structure 10 comprises a winding core 11 and a sheet 12 (see FIG. 2A). The winding core 11 has an outer surface 13, wherein the outer surface 13 of the winding core 11 comprises a recess 14 thereon. The sheet 12 is winded over the outer surface 13 of the winding core 11, wherein a beginning portion 15 of the sheet 12 is disposed in the recess 14. Preferably, the winding core is a tube body. The sheet 12 extending from the recess 14 of the winding core 11 and winded over the outer surface 13 of the winding core 11 reduces indentation transfer occurring because of sheet thickness or adhesive colloidality of the innermost layer of the sheet 12.

Figure 1B:
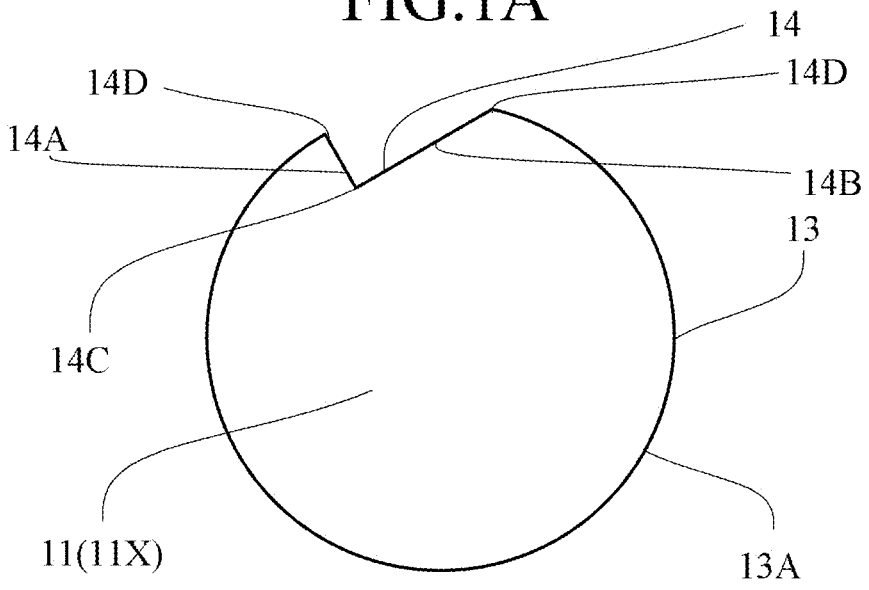
FIG. 1B illustrates a schematic cross-sectional view of a winding core having an outer surface comprising a recess thereon in accordance with a first embodiment in the present invention, wherein the winding core in FIG. 1A can be rotated to see the winding core in FIG. 1B.
Figure 1C:
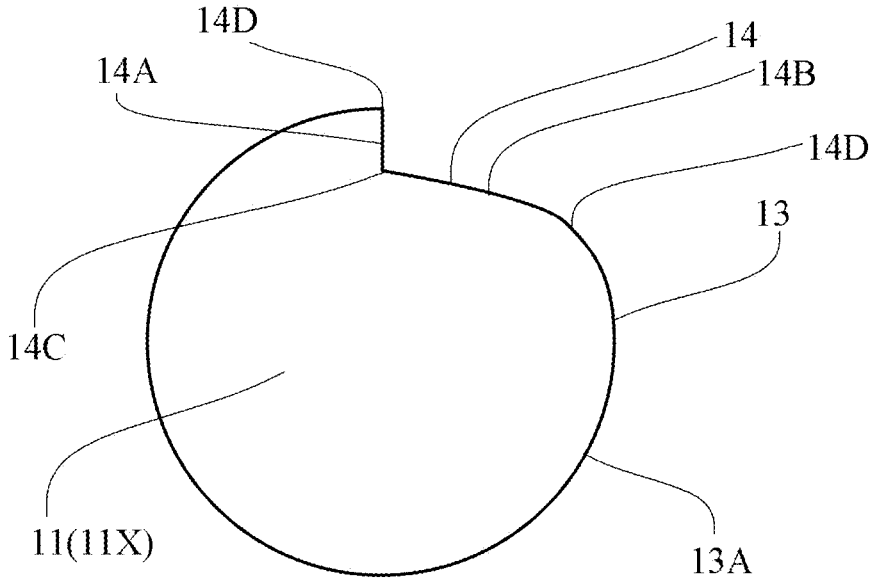
FIG. 1C illustrates a schematic cross-sectional view of a winding core having an outer surface comprising a recess thereon in accordance with a first embodiment in the present invention, wherein the second surface of the recess is a curved surface.
Figure 2A:
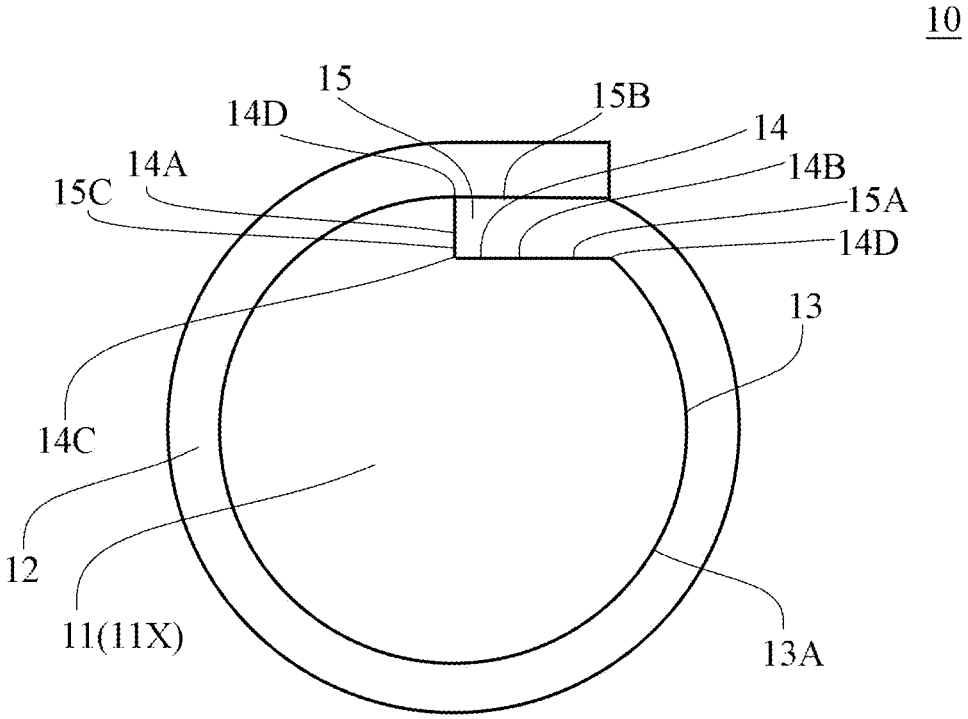
FIG. 2A illustrates a schematic cross-sectional view of a sheet winding structure having a winding core in FIG. 1A in accordance with a first embodiment in the present invention.

FIG. 1A illustrates a schematic cross-sectional view of a winding core 11 having an outer surface 13 comprising a recess 14 thereon in accordance with a first embodiment in the present invention (for convenience of description, the recess 14 is enlarged so it does not meet actual size). The recess 14 is formed by two sidewalls 14A, 14B. The two sidewalls 14A, 14B intersect at the bottom 14C of the recess 14 (see FIG. 1B, the winding core 11 in FIG. 1A can be rotated to see the winding core 11 in FIG. 1B). FIG. 2A illustrates a schematic cross-sectional view of a sheet winding structure 10 having a winding core 11 in FIG. 1A in accordance with a first embodiment in the present invention. The beginning portion 15 of the sheet 12 comprises a first face 15A and a second face 15B opposite to the first face 15A, wherein the first face 15A faces (or contacts) the recess 14 and the second face 15B faces (or contacts) the second layer of the sheet 12 winded over the outer surface 13 of the winding core 11. The beginning portion 15 of the sheet 12 comprises a thickness face 15C (it is much thinner in fact and can be ignored) connecting the first face 15A and the second face 15B, and the recess 14 comprises a first surface 14A and a second surface 14B different from the first surface 14A, wherein the thickness face 15C faces (or contacts) the first surface 14A of the recess 14, and the first face 15A faces (or contacts) the second surface 14B of the recess 14. It is convenient to dispose the first face 15A of the beginning portion 15 of the sheet 12 over the second surface 14B of the recess 14 because of the deigned second surface 14B of the recess 14, so the second surface 14B of the recess 14 is not limited to a plane (see FIG. 1C, the second surface 14B of the recess 14 is a curved surface). In a preferred embodiment, each of the first surface 14A and the second surface 14B of the recess 14 is a plane (i.e. the recess 14 is an L-type or V-type recess, see FIG. 1A). The angle between the first surface 14A and the second surface 14B of the recess 14 can be an acute angle, a right angle or an obtuse angle, preferably, the angle is a right angle.

Figure 3:
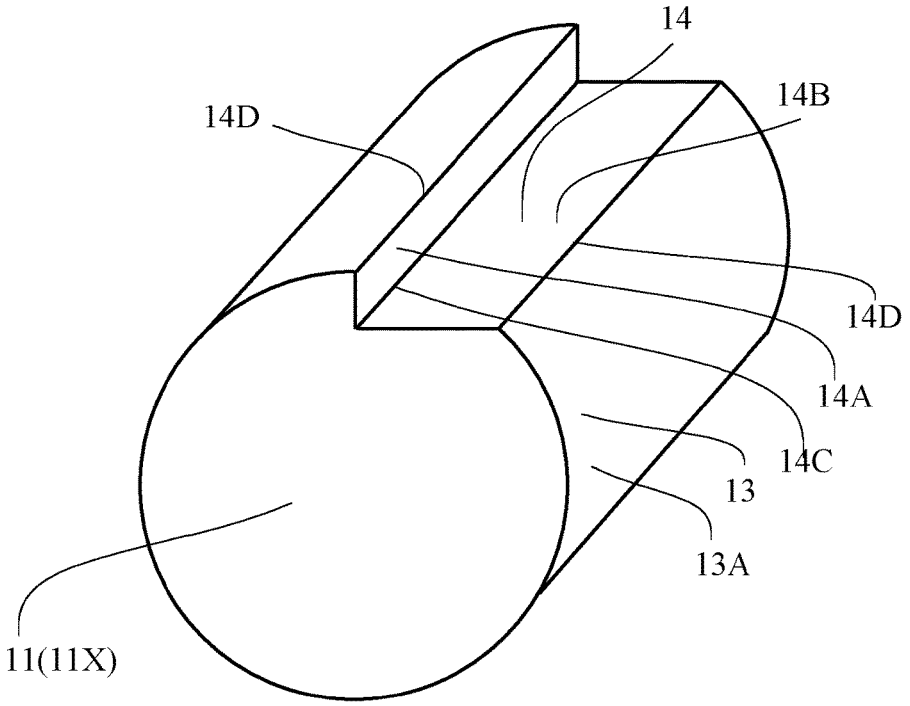
FIG. 3 illustrates a three-dimensional schematic view of a winding core having an outer surface comprising a recess thereon in accordance with a first embodiment in the present invention.

FIG. 3 illustrates a three-dimensional schematic view of a winding core having an outer surface comprising a recess thereon in accordance with a first embodiment in the present invention. The first surface and the second surface of the recess can be formed by using laser or milling cutter to cut the outer surface of the winding core.

Specifically speaking, the outer surface 13 of the winding core 11 comprises a non-concave surface 13A connected to the recess 14, wherein the first surface 14A and the second surface 14B of the recess 14 intersect to define the bottom 14C of the recess 14, and the first surface 14A and the second surface 14B of the recess 14 respectively intersect with the non-concave surface 13A to define the top 14D of the recess 14.

The extending plane of the first surface 14A of the recess 14 can pass the central axis of the winding core 11. The extending plane of the first surface 14A of the recess 14 also can not pass the central axis of the winding core 11.

The thickness of the sheet 12 can be substantially equal to the length of the first surface 14A of the recess 14 (see FIG. 2A). The thickness of the sheet 12 can be larger than the length of the first surface 14A of the recess 14. The thickness of the sheet 12 can be larger than the length of the first surface 14A of the recess 14 by 0.01~50 μm, or 0.01~40 μm, or 0.01~30 μm, or 0.01~20 or 0.01~10 μm. The thickness of the sheet 12 can be smaller than the length of the first surface 14A of the recess 14 by 0.01~50 μm, or 0.01~40 μm, or 0.01~30 or 0.01~20 μm, or 0.01~10 μm. The difference between the thickness of the sheet 12 and the length of the first surface 14A of the recess 14 can be 0~12%, or 0~6%, or 0~5%, or 0~2% time the length of the first surface 14A of the recess 14; preferably, the thickness of the sheet 12 is larger than the length of the first surface 14A of the recess 14.

Figure 2B:
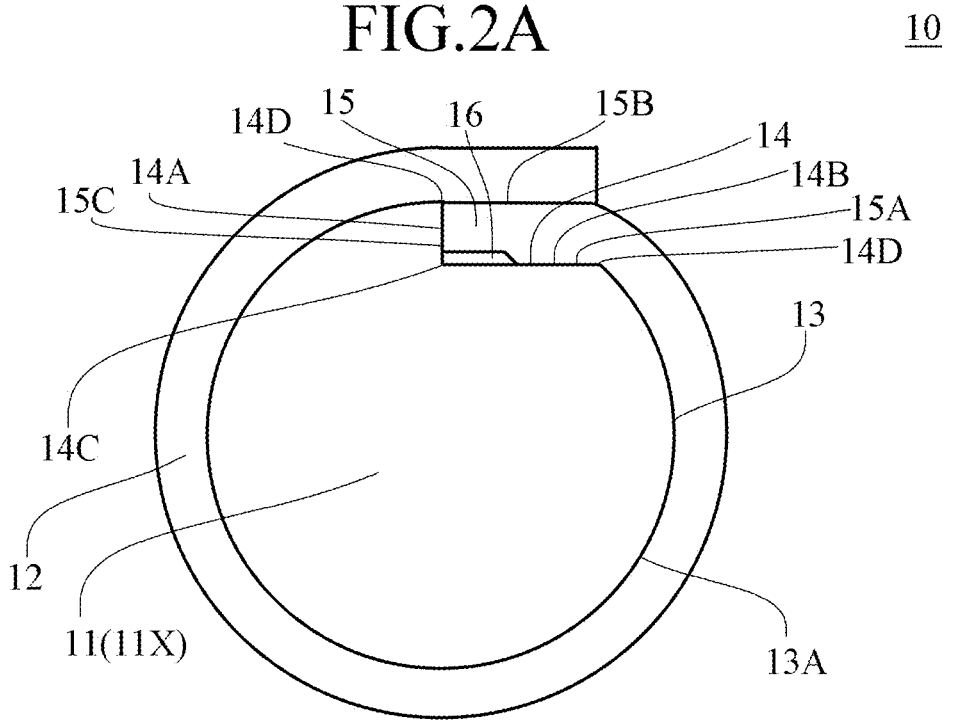
FIG. 2B illustrates a schematic cross-sectional view of a sheet winding structure having a winding core in FIG. 1A in accordance with a first embodiment in the present invention, wherein an adhesive is disposed between the winding core and the sheet to fix the sheet to the second surface of the recess.

An adhesive 16 can be disposed between the winding core 11 and the sheet 12 to fix the sheet 12 to the second surface 14B of the recess 14 (see FIG. 2B). The adhesive 16 can be a double-side adhesive tape or glue. The thickness of the adhesive 16 can be 10~50 μm, and the width of the adhesive 16 (parallel to the second surface 14B of the recess 14) can be 7~17 mm. The adhesive 16 disposed between the winding core 11 and the sheet 12 can have any suitable disposition, for example, the adhesive 16 is only disposed between the winding core 11 and the beginning portion 15 of the sheet 12. The length of the second surface 14B of the recess 14 can be ranged from the width of the adhesive 16 minus 5 mm to the width of the adhesive 16 plus 5 mm.

The sum of the thickness of the sheet 12 and the thickness of the adhesive 16 can be substantially equal to the length of the first surface 14A of the recess 14 (see FIG. 2B). The sum of the thickness of the sheet 12 and the thickness of the adhesive 16 can be larger than the length of the first surface 14A of the recess 14. The sum of the thickness of the sheet 12 and the thickness of the adhesive 16 can be larger than the length of the first surface 14A of the recess 14 by 0.01~50 μm, or 0.01~40 or 0.01~30 μm, or 0.01~20 or 0.01~10 μm. The sum of the thickness of the sheet 12 and the thickness of the adhesive 16 can be smaller than the length of the first surface 14A of the recess 14 by 0.01~50 μm, or 0.01~40 μm, or 0.01~30 μm, or 0.01~20 μm, or 0.01~10 μm. Because the adhesive 16 is more elastic than the sheet 12, the adhesive 16 can compensate for the difference between "the sum of the thickness of the sheet 12 and the thickness of the adhesive 16" and "the length of the first surface 14A of the recess 14" to further reduce or eliminate the indentation transfer. The difference between "the sum of the thickness of the sheet 12 and the thickness of the adhesive 16" and "the length of the first surface 14A of the recess 14" can be determined according to the elasticity of the adhesive 16 (or the ratio of the thickness of the sheet 12 to the thickness of the adhesive 16"). The difference between "the sum of the thickness of the sheet 12 and the thickness of the adhesive 16" and "the length of the first surface 14A of the recess 14" can be 0~12%, or 0~6%, or 0~5%, or 0~2% time the length of the first surface 14A of the recess 14; preferably, the sum of the thickness of the sheet 12 and the thickness of the adhesive 16 can be larger than the length of the first surface 14A of the recess 14.

Experiment 1:

The experiment 1 takes a test of "the sum of the thickness of the sheet 12 and the thickness of the adhesive 16" vs "the length of the first surface 14A of the recess 14" to prove the improvement of the indentation transfer.

TABLE 1

| (A) the sum of the thickness of the sheet and the thickness of the adhesive (μm) | (B) the length of the first surface of the recess (μm) | ((A) − (B))/(B) | (A) − (B) (μm) | indentation transfer (m) |
|---|---|---|---|---|
| 295 | 250 | 18.0% | 45 | 15~25 |
| | 280 | 5.4% | 15 | 0~5 |
| | 290 | 1.7% | 5 | 0~6 |
| | 300 | −1.7% | −5 | 2~9 |
| | 310 | −4.8% | −15 | 4~9 |
| | 350 | −15.7% | −55 | 16~29 |

According to above test result, the difference between "the sum of the thickness of the sheet 12 and the thickness of the adhesive 16" and "the length of the first surface 14A of the recess 14" which is 0~6%, or 0~5%, or 0~2% time the length of the first surface 14A of the recess 14 can largely reduce indentation transfer.

Figure 1D:
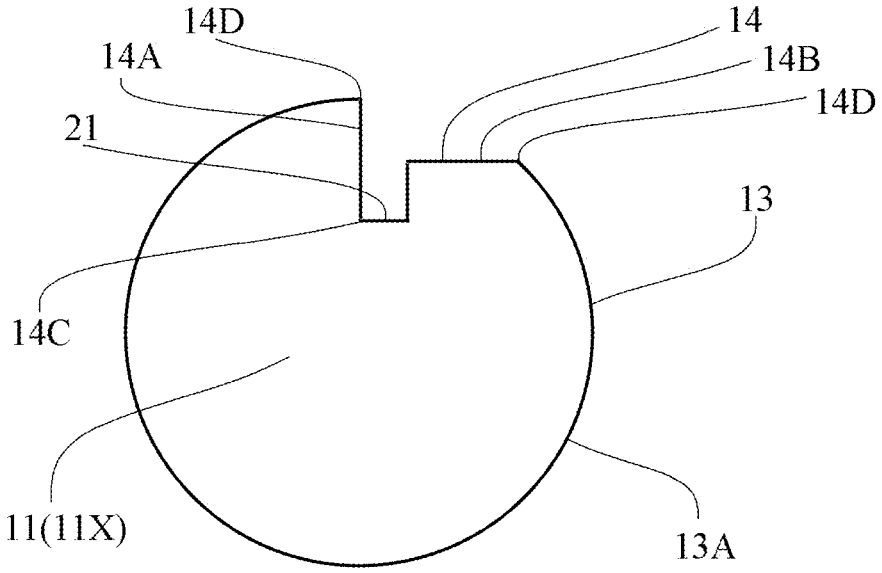
FIG. 1D illustrates a schematic cross-sectional view of a winding core having an outer surface comprising a recess thereon in accordance with a first embodiment in the present invention, wherein a cavity is formed in the recess in FIG. 1A, FIG. 1B or FIG. 1C.
Figure 2C:
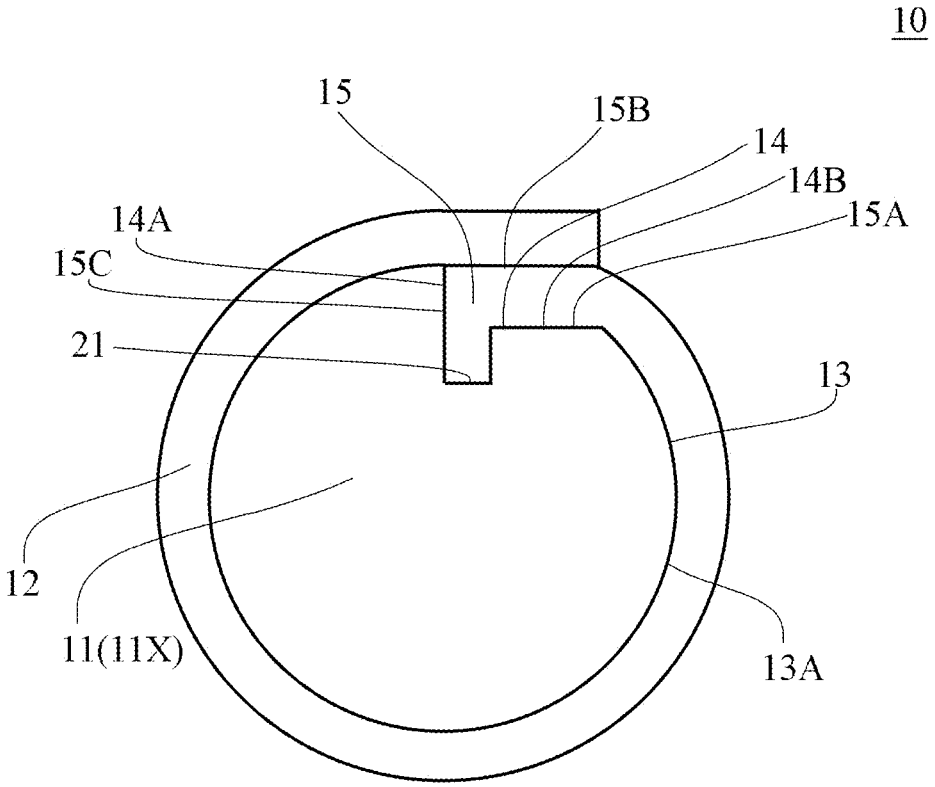
FIG. 2C illustrates a schematic cross-sectional view of a sheet winding structure having a winding core in FIG. 1D in accordance with a first embodiment in the present invention, wherein the beginning portion of the sheet is inserted into the cavity of the winding core for fixing the sheet to the second surface of the recess.

In one embodiment, a cavity 21 can be formed in the above-described recess 14 (see FIG. 1D), so that the beginning portion 15 of the sheet 12 can be inserted into the cavity 21 of the recess 14 for fixing the sheet 12 to the second surface 14B of the recess 14 (see FIG. 2C). Preferably, the opening of the cavity 21 is smaller than that of the recess 14.

Figure 4A:
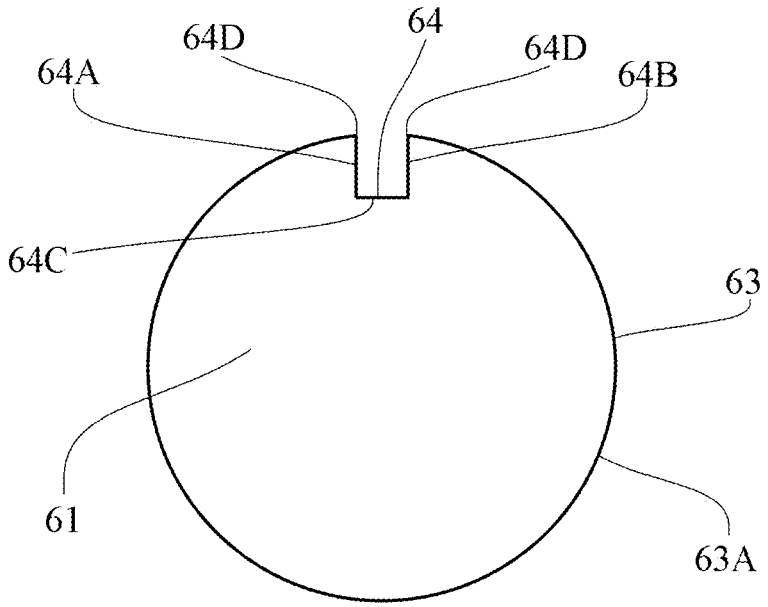
FIG. 4A illustrates a schematic cross-sectional view of a winding core having an outer surface comprising a recess thereon in accordance with a second embodiment in the present invention.
Figure 4B:
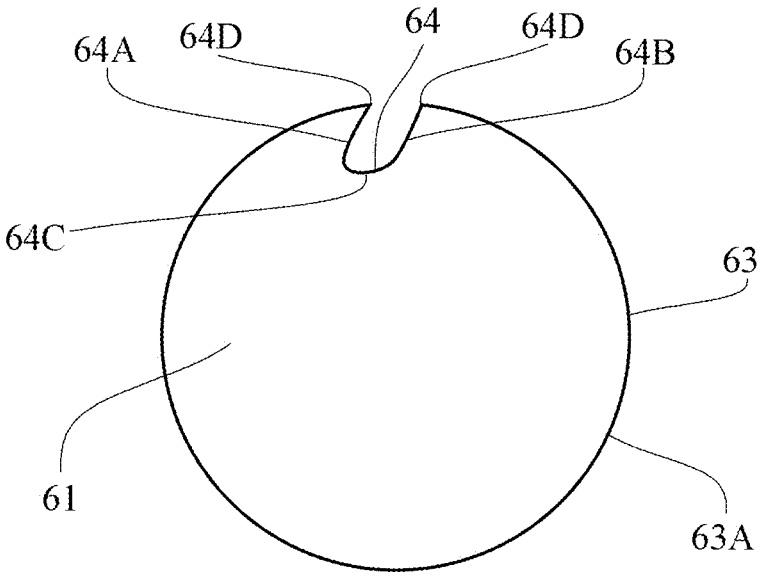
FIG. 4B illustrates that the depth direction of the recess is not perpendicular to the outer surface of the winding core.
Figure 5:
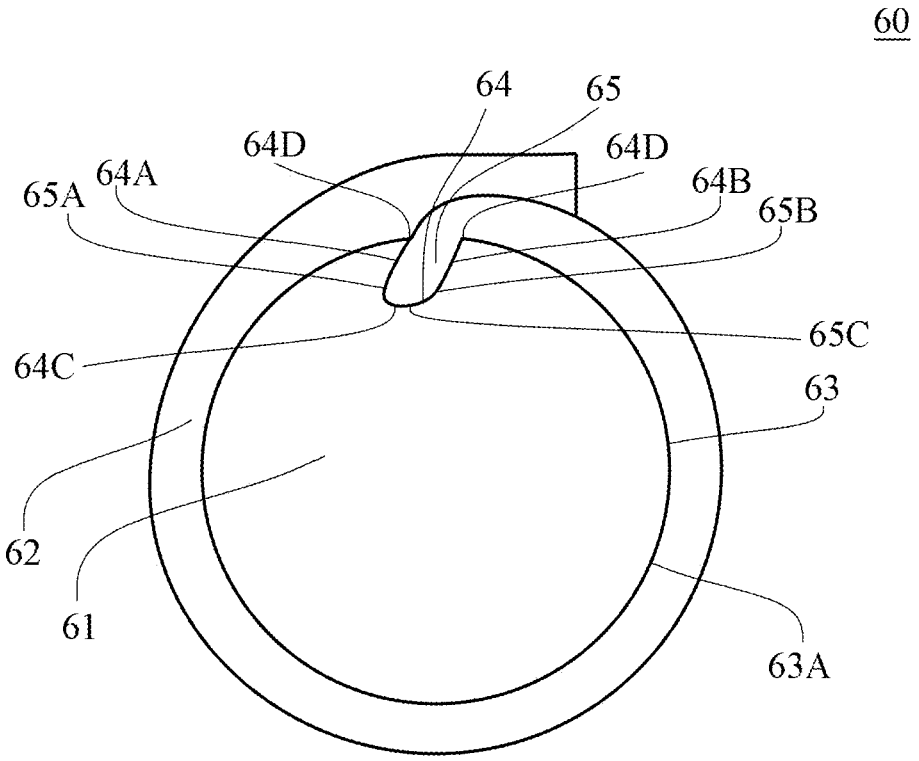
FIG. 5 illustrates a schematic cross-sectional view of a sheet winding structure having a winding core in FIG. 4B in accordance with a second embodiment in the present invention.

FIG. 4A illustrates a schematic cross-sectional view of a winding core 61 having an outer surface 63 comprising a recess 64 thereon in accordance with a second embodiment in the present invention (for convenience of description, the recess 64 is enlarged so it does not meet actual size). FIG. 4B illustrates that the depth direction of the recess 64 is not perpendicular to the outer surface 63 of the winding core 61. The recess 64 is formed by two sidewalls 64A, 64B and a bottom surface 64C between the two sidewalls 64A, 64B. FIG. 5 illustrates a schematic cross-sectional view of a sheet winding structure 60 having a winding core 61 in FIG. 4B in accordance with a second embodiment in the present invention. The beginning portion 65 of the sheet 62 comprises a first face 65A and a second face 65B opposite to the first face 65A, wherein the recess 64 comprises a first surface 64A and a second surface 64B opposite to the first surface 64A, wherein the first face 65A faces (or contacts) the first surface 64A of the recess 64 and the second face 65B faces (or contacts) the second surface 64B of the recess 64. The beginning portion 65 of the sheet 62 comprises a thickness face 65C (it is much thinner in fact and can be ignored) connecting the first face 65A and the second face 65B, and the recess 64 comprises a third surface 64C between the first surface 64A and the second surface 64B, wherein the thickness face 65C faces (or contacts) the third surface 64C of the recess 64. It is convenient to insert the beginning portion 65 of the sheet 62 into the recess 64 of the winding core 61 because of the deigned recess 64, so any of the first surface 64A, the second surface 64B and the third surface 64C of the recess 64 is not limited to a plane (see FIG. 4B, the third surface 64C of the recess 64 is a curved surface). In a preferred embodiment, each of the first surface 64A, the second surface 64B and the third surface 64C of the recess 64 is a plane (i.e. the recess 64 is a U-type recess, see FIG. 4A).

Specifically speaking, the outer surface 63 of the winding core 61 comprises a non-concave surface 63A connected to the recess 64, wherein the third surface 64C connects the first surface 64A to the second surface 64B to define the bottom 64C of the recess 64, and the first surface 64A and the second surface 64B respectively intersect with the non-concave surface 63A to define the top 64D of the recess 64.

Figure 6:
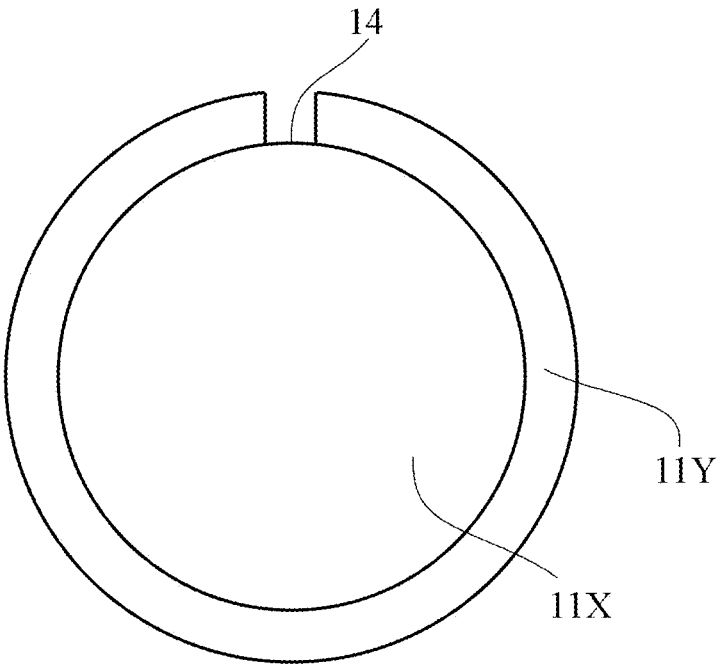
FIG. 6 illustrates a schematic cross-sectional view of a sheet winding structure, wherein the recess is formed only by the foaming material.
Figure 7:
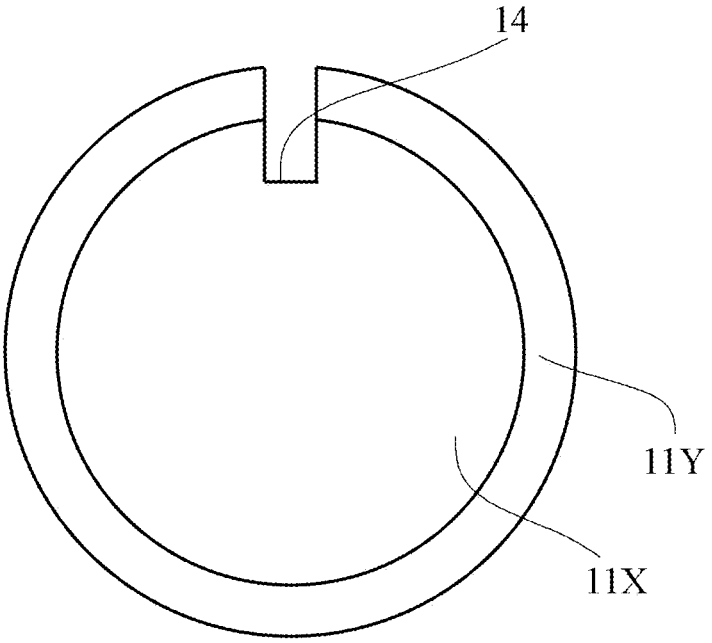
FIG. 7 illustrates a schematic cross-sectional view of a sheet winding structure, wherein the recess is formed by a combination of the foaming material and the central body.

The winding core 11 can be composed of composite layers; for example, the composite layers comprise a central body 11X and a foaming material 11Y encapsulating the central body 11X. In one embodiment, the winding core 11 does not have a foaming material encapsulating the central body 11X, the recess 14 can be formed only by the central body 11X (see FIG. 1A). The winding core 11 can be a tube body, such as paper tube or ABS tube. In one embodiment, the winding core 11 has a foaming material 11Y encapsulating the central body 11X, the recess 14 can be formed only by the foaming material 11Y (see FIG. 6) or formed by a combination of the foaming material 11Y and the central body 11X (see FIG. 7).

The present invention also discloses a method of forming a sheet winding structure. The method comprises: provide a winding core having an outer surface, wherein the outer surface of the winding core comprises a recess thereon; and wind a sheet over the outer surface of the winding core, wherein a beginning portion of the sheet is disposed in the recess.

Figure 8:
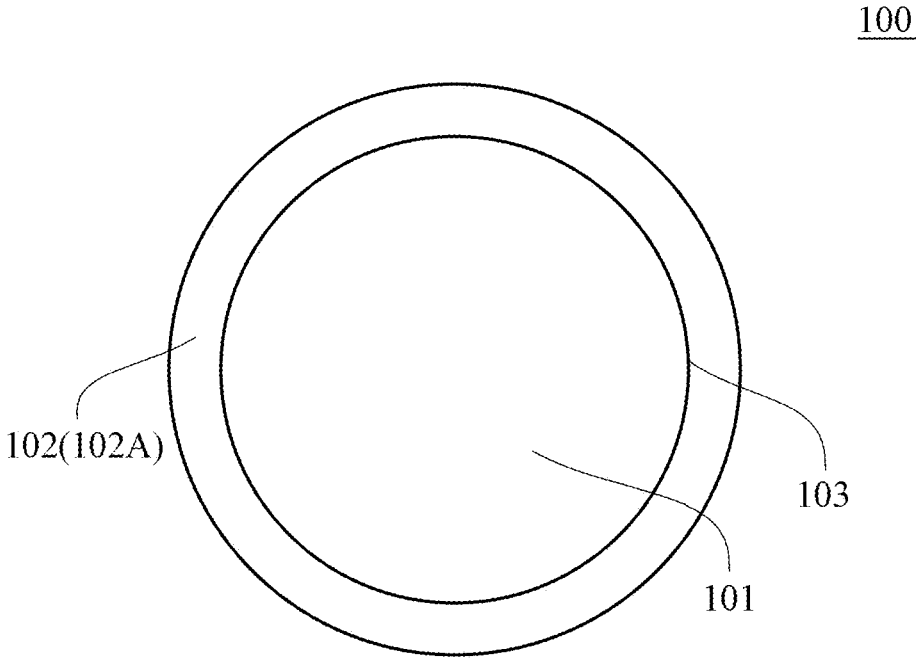
FIG. 8 illustrates a schematic cross-sectional view of a winding core comprising a core body and a buffer layer (e.g., elastic layer).

The present invention also discloses a winding core used for winding a sheet to reduce indentation transfer occurring because of sheet thickness or adhesive colloidality of the innermost layer of the sheet. FIG. 8 illustrates a schematic cross-sectional view of a winding core 100 comprising a core body 101 and a buffer layer 102 (e.g., elastic layer). The buffer layer 102 is disposed on the outer surface 103 of the core body 101. The buffer layer 102 comprises a foaming material 102A. The composition of the foaming material 102A is a combination of LDPE (low-density polyethylene), EPDM (ethylene propylene diene monomer), Azodicarbonamide and auxiliary agent; preferably, the foaming material 102A comprises more than 90% of LDPE (low-density polyethylene). The foaming magnification of the foaming material 102A is 10~33. The decomposition temperature of the foaming material 102A is larger than 300° C.; the melting point of the foaming material 102A is 100~130° C.

The foaming material 102A used in the buffer layer 102 can effectively reduces the gap between the beginning portion of the first layer of the sheet and the core body 101 to further reduce or eliminate the indentation transfer. The core body 101 can be a tube body, such as paper tube or ABS tube. The inner diameter of the tube body can be 3 inch or 6 inch. Preferably, the foaming material 102A can be made of any suitable material, such as elastic foaming resin material.

The density of the foaming material 102A is 0.0286~0.0375 g/cm$^3$. The thickness of the foaming material 102A is 1~3.3 mm, or 1.5~3.3 mm, or 2~3.3 mm, or 2.4~3.3 mm, or 2.8~3.3 mm. The foaming magnification of the foaming material 102A is 10~33, or 15~33, or 20~33, or 25~33, or 28~33, or 31~33.

The unwinding buffer layer 102 can be trimmed into a rectangular sheet; the length of the rectangular sheet is the perimeter of the core body 101 and the width of the rectangular sheet is the height of the core body 101. By using backing glue or jet glue as an adhesive, stick the buffer layer 102 on the core body 101 to form an elastic buffer layer 102 such that there is no seam between the buffer layer 102 and the core body 101.

Experiment 2:

The experiment 2 takes a crossing test for the foaming material disposed on the paper tube, staying time and sheet-winding length to prove the improvement of the indentation transfer. A means unimproved foaming material (thickness: 1 mm; foaming magnification: 40~50; composition: EPE foam) and B means foaming material used in the present invention. The thickness of the sheet is about 50 μm.

TABLE 2

| No. | foaming material | staying time | sheet length | indentation transfer (m) |
|---|---|---|---|---|
| 1 | none | a week | 250 | 50 |
| 2 | A | a week | 250 | 15 |
| 3 | B | a week | 250 | 1 |
| 4 | A | a week | 500 | 30 |
| 5 | B | a week | 500 | 4 |
| 6 | none | two weeks | 250 | 60 |
| 7 | A | two weeks | 250 | 20 |
| 8 | B | two weeks | 250 | 1 |

According to above test result, indentation transfer has been largely reduced by the foaming material (B) used in the present invention. For the sheets having 250 m in length and staying for a week and two weeks, the indentation transfer is only 1 m; for the sheet having 500 m in length and staying for one week, the indentation transfer is only 4 m.

Experiment 3:

The experiment 3 takes a test for whether the foaming material in the present invention is used in winding the sheet having 188 μm of thickness over the outer surface of the winding core to prove the improvement of the indentation transfer. The indentation transfer has been largely reduced from 14 m (no the foaming material in the present invention) to 9 m (the foaming material in the present invention).

Experiment 4:

The experiment 4 takes a test for whether the foaming material in the present invention is used in winding the sheet having 250 μm of thickness over the outer surface of the winding core to prove the improvement of the indentation transfer. The indentation transfer has been largely reduced from 21 m (no the foaming material in the present invention) to 0 m (the foaming material in the present invention).

It follows from description of the above embodiments that the sheet winding structure in the present invention and the method for manufacturing the same can offer many advantages including: 1. reduce indentation transfer occurring because of sheet thickness or adhesive colloidality of the innermost layer of the sheet; 2. there can be no foaming material between the winding core and the sheet such that the production cost can be reduced.

The above disclosure is related to the detailed technical contents and inventive features thereof. People skilled in this field may proceed with a variety of modifications and replacements based on the disclosures and suggestions of the invention as described without departing from the characteristics thereof.

Nevertheless, although such modifications and replacements are not fully disclosed in the above descriptions, they have substantially been covered in the following claims as appended.

What is claimed is:

1. A sheet winding structure having a winding core having an outer surface for winding an optical sheet, wherein the outer surface of the winding core comprises a recess thereon, wherein the recess is formed by a sidewall and a bottom surface connected to the sidewall, wherein the optical sheet comprises a beginning portion disposed in the recess, wherein the beginning portion comprises a first major surface disposed on the bottom surface of the recess, a second major surface opposite to the first major surface and a thickness surface facing the sidewall of the recess, wherein the length of the sidewall of the recess is less than 0.35 millimeter and the bottom surface of the recess is a flat surface for placing the beginning portion of the optical sheet thereon so as to reduce the indentation transfer of the optical sheet winded over the outer surface of the winding core.

2. The sheet winding structure according to the claim 1, wherein the outer surface of the winding core comprises a non-concave surface having a first edge and a second edge, wherein the first edge is connected to the sidewall of the recess and the second edge is connected to the bottom surface of the recess.

3. The sheet winding structure according to the claim 1, wherein the sidewall of the recess is substantially perpendicular to the bottom surface of the recess.

4. The sheet winding structure according to the claim 1, wherein the extending plane of the sidewall of the recess passes the central axis of the winding core.

5. The sheet winding structure according to the claim 1, wherein the extending plane of the sidewall of the recess does not pass the central axis of the winding core.

6. The sheet winding structure according to the claim 1, wherein the optical sheet has a first thickness and the sidewall of the recess has a first length, wherein the first thickness is substantially equal to the first length.

7. The sheet winding structure according to the claim 1, wherein the optical sheet has a first thickness and the sidewall of the recess has a first length, wherein the first thickness is larger than the first length.

8. The sheet winding structure according to the claim 1, wherein the optical sheet has a first thickness and the sidewall of the recess has a first length, wherein the difference between the first thickness and the first length is 0~12% time the first length.

9. The sheet winding structure according to the claim 1, wherein the optical sheet has a first thickness and the sidewall of the recess has a first length, wherein the first thickness is larger than the first length by 0.01~10 μm.

10. The sheet winding structure according to the claim 1, wherein the optical sheet has a first thickness and the sidewall of the recess has a first length, wherein the first thickness is smaller than the first length by 0.01~10 μm.

11. The sheet winding structure according to the claim 1, wherein an adhesive is disposed between the winding core and the optical sheet to fix the optical sheet to the bottom surface of the recess.

12. The sheet winding structure according to the claim 11, wherein the optical sheet has a first thickness, the adhesive has a second thickness and the sidewall of the recess has a first length, wherein the sum of the first thickness and the second thickness is substantially equal to the first length.

13. The sheet winding structure according to the claim 11, wherein the optical sheet has a first thickness, the adhesive has a second thickness and the sidewall of the recess has a first length, wherein the difference between the sum of the first thickness and the second thickness and the first length is 0~12% time the first length.

14. The sheet winding structure according to the claim 11, wherein the optical sheet has a first thickness, the adhesive has a second thickness and the sidewall of the recess has a first length, wherein the sum of the first thickness and the second thickness is larger than the first length by 0.01~10 μm.

15. The sheet winding structure according to the claim 11, wherein the optical sheet has a first thickness, the adhesive has a second thickness and the sidewall of the recess has a first length, wherein the sum of the first thickness and the second thickness is smaller than the first length by 0.01~10 μm.

16. The sheet winding structure according to the claim 11, wherein the adhesive is a double-side adhesive tape.

17. The sheet winding structure according to the claim 1, wherein the winding core is a tube body.

18. The sheet winding structure according to the claim 1, wherein the optical sheet is a non-metal optical sheet.

19. The sheet winding structure according to the claim 1, wherein the recess is formed by removing a portion of a cylindrical core.

20. A sheet winding structure having a winding core having an outer surface for winding an optical sheet, wherein the outer surface of the winding core comprises an L-type or V-type recess thereon, wherein the L-type or V-type recess is formed by a sidewall and a bottom surface connected to the sidewall, wherein the optical sheet comprises a beginning portion disposed in the recess, wherein the beginning portion comprises a first major surface disposed on the bottom surface of the recess, a second major surface opposite to the first major surface and a thickness surface facing the sidewall of the recess, wherein the length of the sidewall of the recess is less than 0.35 millimeter and the bottom surface of the recess is a flat surface for placing the beginning portion of the optical sheet thereon so as to reduce the indentation transfer of the optical sheet winded over the outer surface of the winding core.

21. The sheet winding structure according to the claim 20, wherein the outer surface of the winding core comprises a non-concave surface having a first edge and a second edge, wherein the first edge is connected to the sidewall of the recess and the second edge is connected to the bottom surface of the recess.

22. The sheet winding structure according to the claim 20, wherein the sidewall of the recess is substantially perpendicular to the bottom surface of the recess.

23. The sheet winding structure according to the claim 20, wherein an adhesive is disposed between the winding core and the optical sheet to fix the optical sheet to the bottom surface of the recess.

24. The sheet winding structure according to the claim 20, wherein the optical sheet has a first thickness and the sidewall of the recess has a first length, wherein the difference between the first thickness and the first length is 0~12% time the first length.

25. The sheet winding structure according to the claim 20, wherein the optical sheet is a non-metal optical sheet.

26. A sheet winding structure having a winding core having an outer surface for winding an optical sheet, wherein the outer surface of the winding core comprises a recess thereon, wherein the recess is formed by a sidewall and a bottom surface connected to the sidewall, wherein the optical sheet comprises a beginning portion disposed in the recess, wherein the beginning portion comprises a first major surface disposed on the bottom surface of the recess, a second major surface opposite to the first major surface and a thickness surface facing the sidewall of the recess, wherein the length of the sidewall of the recess is less than 0.35 millimeter and the bottom surface of the recess is a flat surface so as to reduce the indentation transfer of the optical sheet winded over the outer surface of the winding core to not larger than 9 meter.

27. The sheet winding structure according to the claim 26, wherein the outer surface of the winding core comprises a non-concave surface having a first edge and a second edge, wherein the first edge is connected to the sidewall of the recess and the second edge is connected to the bottom surface of the recess.

28. The sheet winding structure according to the claim 26, wherein the sidewall of the recess is substantially perpendicular to the bottom surface of the recess.

29. The sheet winding structure according to the claim 26, wherein an adhesive is disposed between the winding core and the optical sheet to fix the optical sheet to the bottom surface of the recess.

30. The sheet winding structure according to the claim 26, wherein the optical sheet is a non-metal optical sheet.

31. The sheet winding structure according to the claim 26, wherein the optical sheet has a first thickness and the sidewall of the recess has a first length, wherein the difference between the first thickness and the first length is 0~12% time the first length.

* * * * *